US008330362B2

(12) United States Patent
Lin

(10) Patent No.: US 8,330,362 B2
(45) Date of Patent: Dec. 11, 2012

(54) LAMP HAVING MOUNTING SLOT

(76) Inventor: Chiu-Min Lin, Guishan Township (TW)

( * ) Notice: Subject to any disclaimer, the term of this patent is extended or adjusted under 35 U.S.C. 154(b) by 271 days.

(21) Appl. No.: 12/841,261

(22) Filed: Jul. 22, 2010

(65) Prior Publication Data

US 2012/0020070 A1 Jan. 26, 2012

(51) Int. Cl.
*F21V 21/00* (2006.01)

(52) U.S. Cl. ..... 313/512; 362/217.1

(58) Field of Classification Search ..... 313/512; 362/217.1–217.17

See application file for complete search history.

(56) References Cited

U.S. PATENT DOCUMENTS 7,052,171 B1 * 5/2006 Lefebvre et al. ..... 362/649
7,307,391 B2 * 12/2007 Shan ..... 315/291
7,556,396 B2 * 7/2009 Kuo et al. ..... 362/217.01
7,815,338 B2 * 10/2010 Siemiet et al. ..... 362/218
7,938,562 B2 * 5/2011 Ivey et al. ..... 362/276
7,997,770 B1 * 8/2011 Meurer ..... 362/311.02
2007/0223225 A1 * 9/2007 Eiich et al. ..... 362/260
2009/0091929 A1 * 4/2009 Faubion ..... 362/234

* cited by examiner

*Primary Examiner* — Nimeshkumar Patel
*Assistant Examiner* — Christopher Raabe
(74) *Attorney, Agent, or Firm* — Alan Kamrath; Kamrath IP Lawfirm, PA

(57) ABSTRACT

A lamp has a light tube, an illuminant module mounted in the light tube and two end caps mounted respectively on two opposite ends of the light tube. A slot, being substantially inverted T-shaped in cross-section, is formed in and axially along the light tube and the end caps. A guide rail or a pair of resilient plates is disposed at a presupposed position and is mounted through the slot of the lamp to hold the lamp. An amount of lamps held on the guide rail or the pair of resilient plates is changeable according to needful brightness. Therefore, disposing the lamp is easy, quick and convenient, and a total cost for disposing the lamp is low.

20 Claims, 4 Drawing Sheets

LAMP HAVING MOUNTING SLOT

BACKGROUND OF THE INVENTION

1. Field of the Invention

The present invention relates to a lamp and, especially, to a lamp that has a mounting slot and is easily set up at a specific position.

2. Description of the Prior Art(s)

A conventional lamp must be used with a lamp holder. The lamp holder is set up at a specific position of a ceiling or a wall in advance, and, then the conventional lamp is mounted onto the lamp holder.

However, usage of the lamp holder increases total cost and complexity of disposing the lamp. Moreover, since the lamp holder is set up at the specific position and only allows for mounting a specific amount of lamps, the amount of lamps is not changed according to needs for brightness.

To overcome the shortcomings, the present invention provides a lamp having a mounting slot to mitigate or obviate the aforementioned problems.

SUMMARY OF THE INVENTION

The main objective of the present invention is to provide a lamp having a mounting slot. The lamp has a light tube, an illuminant module mounted in the light tube and two end caps mounted respectively on two opposite ends of the light tube. A slot, being substantially inverted T-shaped in cross-section, is formed in and axially along the light tube and the end caps.

A guide rail or a pair of resilient plates is disposed at a presupposed position and is mounted through the slot of the lamp to hold the lamp. An amount of lamps held on the guide rail or the pair of resilient plates is changeable according to needful brightness. Therefore, disposing the lamp is easy, quick and convenient, and a total cost for disposing the lamp is low.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
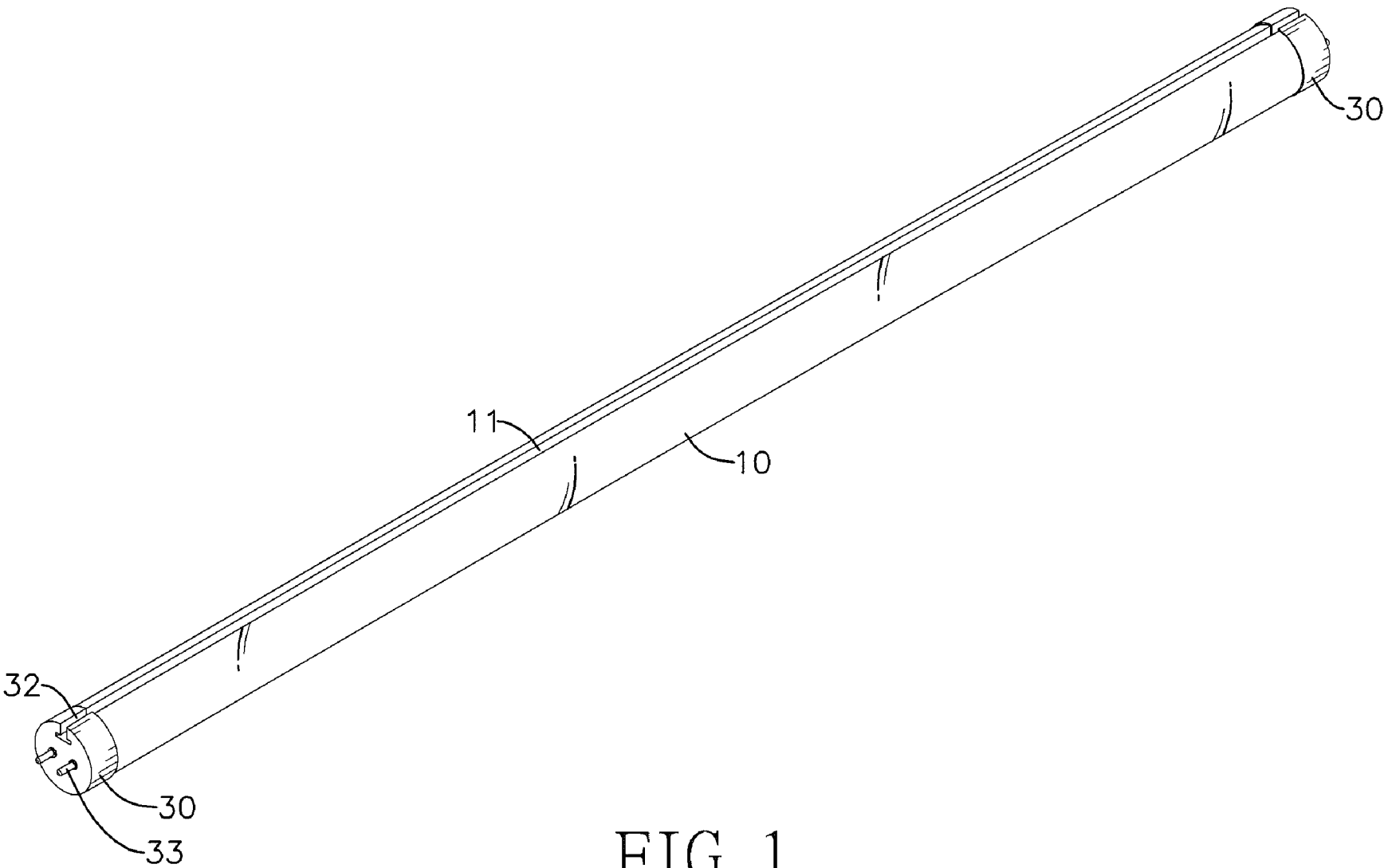
FIG. 1 is a perspective view of a lamp having a mounting slot in accordance with the present invention.
Figure 2:
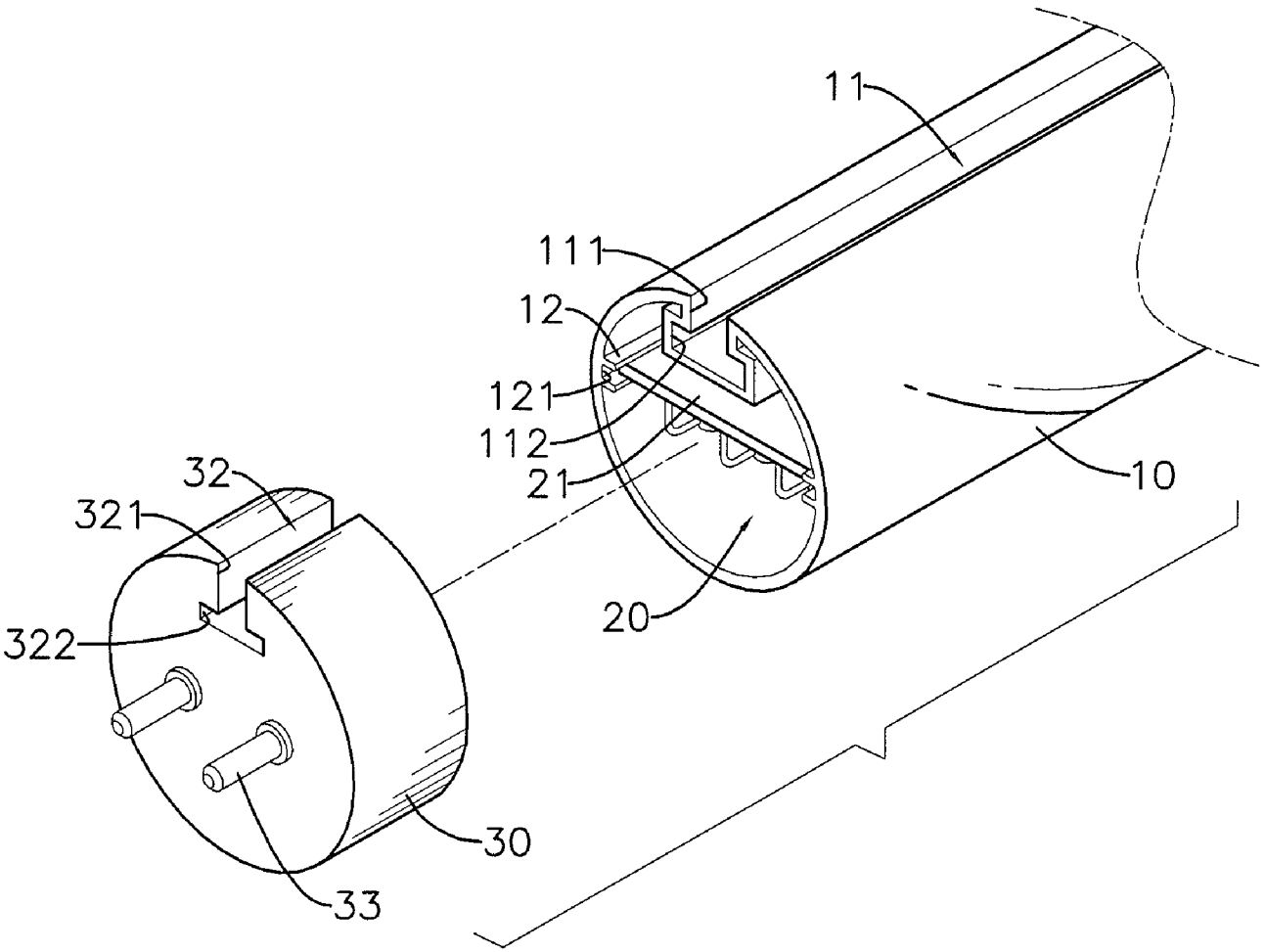
FIG. 2 is an enlarged exploded perspective view of the lamp in FIG. 1.

With reference to FIGS. 1 and 2, a lamp in accordance with the present invention comprises a light tube 10, an illuminant module 20 and two end caps 30.

The light tube 10 is tubular and elongated and has a main slot 11 and two tracks 12.

The main slot 11 is substantially inverted T-shaped in cross-section, is formed in and axially along an outer surface of the light tube 10, is formed through two opposite ends of the light tube 10 and has a mounting recess 111 and two positioning recesses 112. The mounting recess 111 of the main slot 11 is formed in the outer surface of the light tube 10 and having two opposite mounting surfaces. The positioning recesses 112 of the main slot 11 are formed respectively in the mounting surfaces of the mounting recess 111 of the main slot 11.

The tracks 12 are formed on and axially along the inner surface of the light tube 10. Each track 12 has an engaging recess 121 formed along the track 12 and corresponding to the engaging recess 121 of the other track 12.

Figure 3:
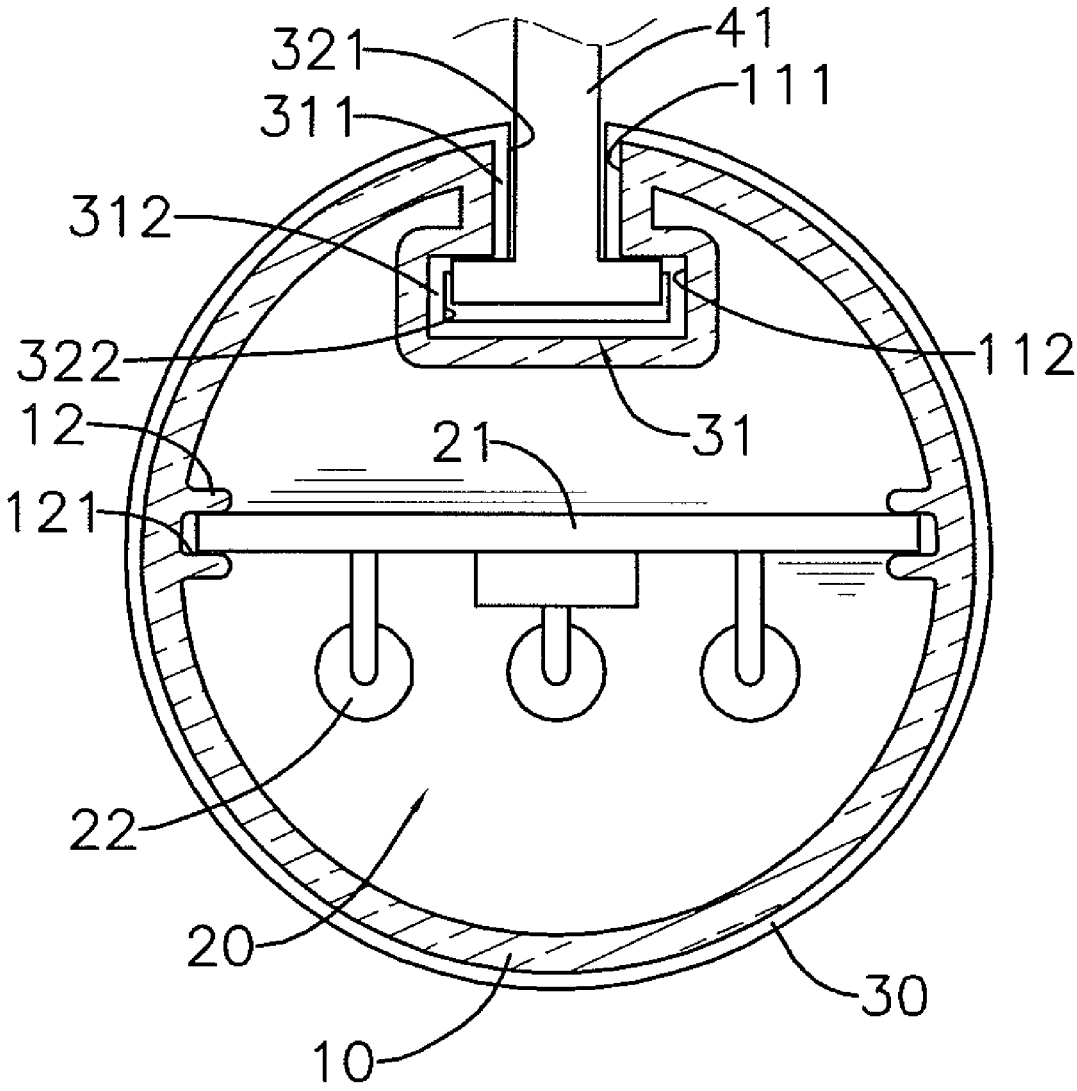
FIG. 3 is an operational end view in partial section of the lamp in FIG. 1.

With further reference to FIG. 3, the illuminant module 20 is mounted in the interior space of the light tube 10, may be a light emitting diode (LED) module and has a substrate 21 and multiple LEDs 22. The substrate 21 has two opposite edges respectively engaging the engaging recesses 121 of the tracks 12 of the light tube 10 so the substrate 21 is held in the light tube 10. The LEDs 22 are mounted on the substrate 21 and are connected electrically to a circuit of the substrate 21.

The end caps 30 are mounted respectively on the ends of the light tube 10. Each end cap 30 has a closed outer end, an open inner end, a positioning mount 31, a secondary slot 32 and two pins 33. The open inner end of the end cap 30 is mounted around a corresponding end of the light tube 10.

The positioning mount 31 is substantially inverted T-shaped in cross-section, is formed on and axially along an inner surface of the end cap 30, corresponds to and is mounted in the main slot 11 of the light tube 10 and has a mounting protrusion 311 and two positioning protrusions 312. The mounting protrusion 311 is formed on the inner surface of the end cap 30, is mounted in the mounting recess 111 of the main slot 11 of the light tube 10 and has two opposite side surfaces. The positioning protrusions 312 are formed respectively on the side surfaces of the mounting protrusion 311, are mounted respectively in the positioning recesses 112 of the main slot 11 of the light tube 10.

The secondary slot 32 is substantially inverted T-shaped in cross-section, is formed in and axially along an outer surface of the end cap 30, is formed through the closed outer end and the open inner end of the end cap 30, communicates with the main slot 11 of the light tube 10 and has a mounting recess 321 and two positioning recesses 322. The mounting recess 321 of the secondary slot 32 is formed through the outer surface of the end cap 30 and in the mounting protrusion 311 of the positioning mount 31 and has two opposite mounting surfaces. The positioning recesses 322 of the secondary slot 32 are formed respectively through the mounting surfaces of the mounting recess 321 of the secondary slot 32 and in the positioning protrusion 312 of the positioning mount 31.

The pins 33 are mounted on the closed outer end of the end cap 30 and are connected electrically to the circuit of the substrate 21 of the illuminant module 20 and a power source by which the illuminant module 20 is powered.

With further reference to FIG. 3, in a preferred embodiment, a guide rail 41, being substantially inverted T-shaped, is disposed at a presupposed position, such as a ceiling, a wall or the like, and is mounted through the secondary slots 32 of the end caps 30 and the main slot 11 of the light tube 10 to hold the lamp on the guide rail 41.

Figure 4:
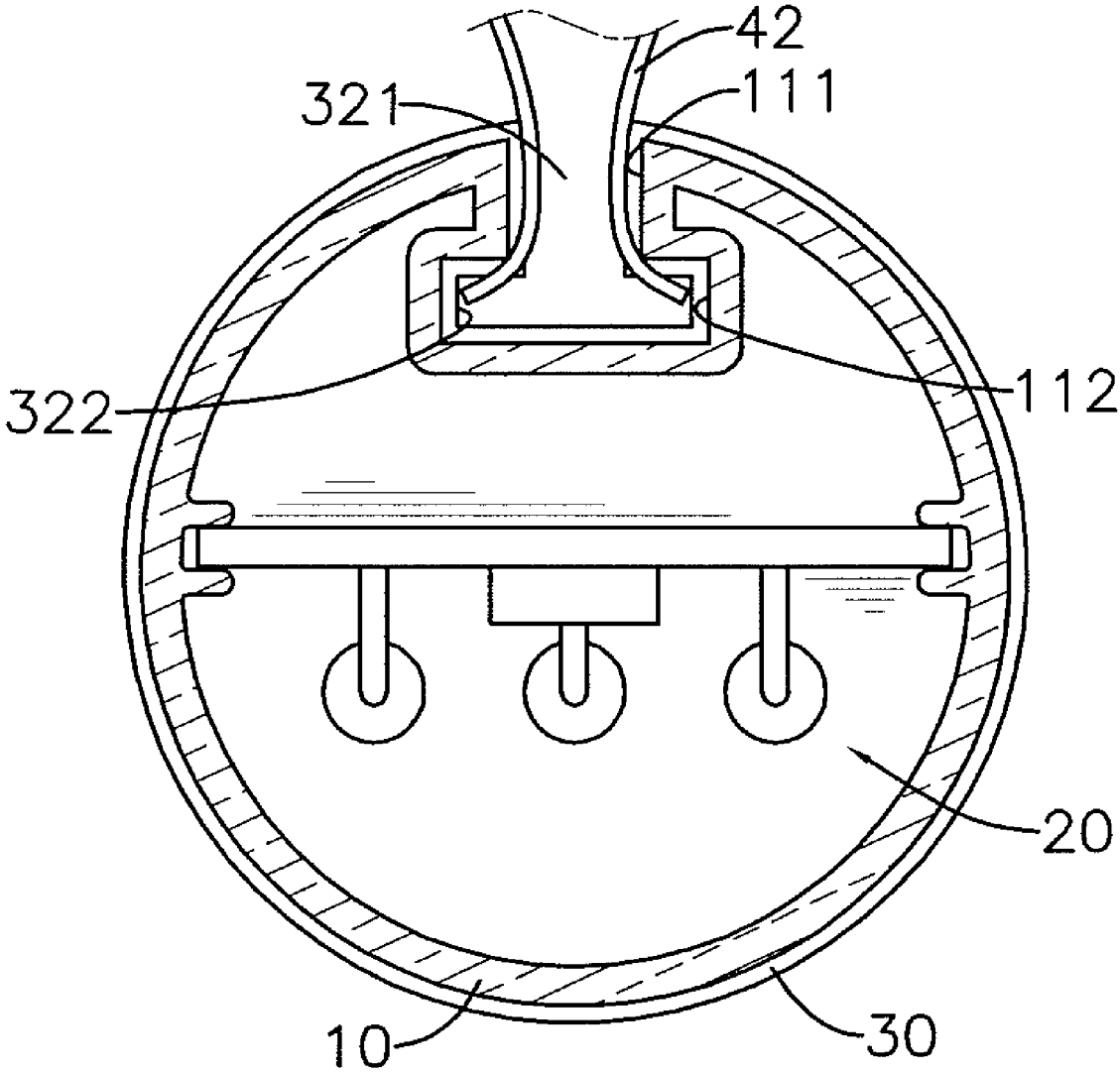
FIG. 4 is another operational end view in partial section of the lamp in FIG. 1.

With further reference to FIG. 4, in another preferred embodiment, a pair of resilient plates 42 is disposed at the presupposed position, is arced toward opposite directions, is mounted through the mounting recesses 111, 321 of the main slot 11 and the secondary slots 32 and respectively engage the positioning recesses 112, 322 of the main slot 11 and the secondary slots 32 to hold the lamp on the pair of resilient plates 42.

The lamp as described has the following advantages. No lamp holder is needed for holding the lamp. As long as the guide rail 41 or the pair of resilient plates 42 is disposed at the presupposed position, the lamp is held accordingly. Moreover, an amount of lamps held on the guide rail 41 or the pair of resilient plates 42 is changeable according to needful brightness. Thus, disposing the lamp is easy, quick and convenient, and a total cost for disposing the lamp is low.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lamp comprising a light tube of an annular cross sections having an outer surface and an inner surface, with the light tube having a main slot formed in and axially along the outer surface of the light tube, with the main slot being substantially inverted T-shape in cross section and having a mounting recess formed in the outer surface of the light tube and having two opposite mounting surfaces; and two positioning recesses formed in the outer surface of the light tube respectively in the mounting surfaces of the mounting recess of the main slot;

an illuminant module mounted within the inner surface of the light tube spaced from the main slot;

two end caps mounted respectively on two opposite ends of the light tube, with each end cap having a closed outer end; and an open inner end mounted around a correspond end of the light tube; and a holder extending through the mounting recess and into each of the two positioning recesses of the main slot.

2. The lamp as claimed in claim 1, wherein the main slot of the light tube is formed through ends of the light tube; and each end cap has a positioning mount formed on and axially along an inner surface of the end cap, corresponding to and mounted in the main slot of the light tube and having a mounting protrusion formed on the inner surface of the end cap, mounted in the mounting recess of the main slot of the light tube and has two opposite side surfaces; and two positioning protrusions formed respectively on the side surfaces of the mounting protrusion, mounted respectively in the positioning recesses of the main slot of the light tube.

3. The lamp as claimed in claim 2, wherein each end cap further has a secondary slot formed in and axially along an outer surface of the end cap, formed through the closed outer end and the open inner end of the end cap, communicating with the main slot of the light tube and being substantially inverted T-shape in cross section, with the secondary slot having a mounting recess formed through the outer surface of the end cap and in the mounting protrusion of the positioning mount and having two opposite mounting surfaces; and two positioning recesses formed in the outer surface of the end cap respectively through the mounting surfaces of the mounting recess of the secondary slot and in the positioning protrusion of the positioning mount.

4. The lamp as claimed in claim 1, wherein the light tube further has two tracks formed on and axially along the inner surface of the light tube, and each track has an engaging recess formed along the track and corresponding to the engaging recess of the other track; and the illuminant module has a substrate having two opposite edges respectively engaging the engaging recesses of the two tracks of the light tube; and multiple LEDs mounted on the substrate and connected electrically to a circuit of the substrate.

5. The lamp as claimed in claim 2, wherein the light tube further has two tracks formed on and axially along the inner surface of the light tube, and each track has an engaging recess formed along the track and corresponding to the engaging recess of the other track; and the illuminant module has a substrate having two opposite edges respectively engaging the engaging recesses of the two tracks of the light tube; and multiple LEDs mounted on the substrate and connected electrically to a circuit of the substrate.

6. The lamp as claimed in claim 3, wherein the light tube further has two tracks formed on and axially along the inner surface of the light tube, and each track has an engaging recess formed along the track and corresponding to the engaging recess of the other track; and the illuminant module has a substrate having two opposite edges respectively engaging the engaging recesses of the two tracks of the light tube; and multiple LEDs mounted on the substrate and connected electrically to a circuit of the substrate.

7. The lamp as claimed in claim 1, wherein each end cap further has two pins mounted on the closed outer end of the end cap and connected electrically to the illuminant module.

8. The lamp as claimed in claim 2, wherein each end cap further has two pins mounted on the closed outer end of the end cap and connected electrically to the illuminant module.

9. The lamp as claimed in claim 3, wherein each end cap further has two pins mounted on the closed outer end of the end cap and connected electrically to the illuminant module.

10. The lamp as claimed in claim 4, wherein each end cap further has two pins mounted on the closed outer end of the end cap and connected electrically to the circuit of the substrate of the illuminant module.

11. The lamp as claimed in claim 5, wherein each end cap further has two pins mounted on the closed outer end of the end cap and connected electrically to the circuit of the substrate of the illuminant module.

12. The lamp as claimed in claim 6, wherein each end cap further has two pins mounted on the closed outer end of the end cap and connected electrically to the circuit of the substrate of the illuminant module.

13. The lamp as claimed in claim 1 wherein the holder comprises a guide rail of an inverted T-shape mounted in the mounting recess.

14. The lamp as claimed in claim 13, wherein the main slot of the light tube is formed through ends of the light tube; and each end cap has a positioning mount formed on and axially along an inner surface of the end cap, corresponding to and mounted in the main slot of the light tube and having a mounting protrusion formed on the inner surface of the end cap, mounted in the mounting recess of the main slot of the light tube and has two opposite side surfaces; and two positioning protrusions formed respectively on the side surfaces of the mounting protrusion, mounted respectively in the positioning recesses of the main slot of the light tube.

15. The lamp as claimed in claim 14, wherein each end cap further has a secondary slot formed in and axially along an outer surface of the end cap, formed through the closed outer end and the open inner end of the end cap, communicating with the main slot of the light tube and being substantially inverted T-shape in cross section, with the secondary slot having a mounting recess formed through the outer surface of the end cap and in the mounting protrusion of the positioning mount and having two opposite mounting surfaces; and two positioning recesses formed in the outer surface of the end cap respectively through the mounting surfaces of the mounting recess of the secondary slot and in the positioning protrusion of the positioning mount.

16. The lamp as claimed in claim 15, wherein the light tube further has two tracks formed on and axially along the inner surface of the light tube, and each track has an engaging recess formed along the track and corresponding to the engaging recess of the other track; and the illuminant module has a substrate having two opposite edges respectively engaging the engaging recesses of the two tracks of the light tube; and multiple LEDs mounted on the substrate and connected electrically to a circuit of the substrate.

17. The lamp as claimed in claim 1 wherein the holder comprises a pair of resilient plates arced toward opposite directions and mounted through the mounting recess, with one of the pair of resilient plates extending into one of the two positioning slots and another of the pair of resilient plates extending into another of the two positioning slots.

18. The lamp as claimed in claim 17, wherein the main slot of the light tube is formed through ends of the light tube; and each end cap has a positioning mount formed on and axially along an inner surface of the end cap, corresponding to and mounted in the main slot of the light tube and having a mounting protrusion formed on the inner surface of the end cap, mounted in the mounting recess of the main slot of the light tube and has two opposite side surfaces; and two positioning protrusions formed respectively on the side surfaces of the mounting protrusion, mounted respectively in the positioning recesses of the main slot of the light tube.

19. The lamp as claimed in claim 18, wherein each end cap further has a secondary slot formed in and axially along an outer surface of the end cap, formed through the closed outer end and the open inner end of the end cap, communicating with the main slot of the light tube and being substantially inverted T-shape in cross section, with the secondary slot having a mounting recess formed through the outer surface of the end cap and in the mounting protrusion of the positioning mount and having two opposite mounting surfaces; and two positioning recesses formed in the outer surface of the end cap respectively through the mounting surfaces of the mounting recess of the secondary slot and in the positioning protrusion of the positioning mount.

20. The lamp as claimed in claim 19, wherein the light tube further has two tracks formed on and axially along the inner surface of the light tube, and each track has an engaging recess formed along the track and corresponding to the engaging recess of the other track; and the illuminant module has a substrate having two opposite edges respectively engaging the engaging recesses of the two tracks of the light tube; and multiple LEDs mounted on the substrate and connected electrically to a circuit of the substrate.

* * * * *